US008939010B2

(12) United States Patent
Levijoki et al.

(10) Patent No.: US 8,939,010 B2
(45) Date of Patent: Jan. 27, 2015

(54) SYSTEM AND METHOD FOR DIAGNOSING FAULTS IN AN OXYGEN SENSOR

(75) Inventors: Stephen Paul Levijoki, Swartz Creek, MI (US); Thomas J. Majcher, Orchard Lake, MI (US); John W. Siekkinen, Novi, MI (US); Michael John Dokter, Okemos, MI (US); Scott Jeffrey, Hartland, MI (US)

(73) Assignee: GM Global Technology Operations LLC

( * ) Notice: Subject to any disclaimer, the term of this patent is extended or adjusted under 35 U.S.C. 154(b) by 375 days.

(21) Appl. No.: 13/286,717

(22) Filed: Nov. 1, 2011

(65) Prior Publication Data

US 2013/0104626 A1 May 2, 2013

(51) Int. Cl.
*F02D 41/22* (2006.01)
*F02D 41/14* (2006.01)

(52) U.S. Cl.
CPC ..... *F02D 41/1454* (2013.01); *F02D 41/1495* (2013.01); *F02D 41/1456* (2013.01)
USPC ..... 73/23.32; 123/688; 123/690; 701/107

(58) Field of Classification Search
CPC ..... F02D 41/1495
USPC ..... 73/23.32; 123/688, 690; 701/107, 109
See application file for complete search history.

(56) References Cited

U.S. PATENT DOCUMENTS

| | | | | |
|---|---|---|---|---|
| 4,214,308 | A * | 7/1980 | Carp | 701/114 |
| 4,928,518 | A | 5/1990 | Tamura | |
| 5,357,791 | A | 10/1994 | Gee et al. | |
| 5,390,650 | A | 2/1995 | Gee et al. | |
| 5,485,382 | A * | 1/1996 | Seki et al. | 701/109 |
| 5,970,967 | A * | 10/1999 | Uchikawa | 123/688 |
| 7,266,942 | B2 | 9/2007 | Iihoshi et al. | |
| 7,549,284 | B2 | 6/2009 | Iihoshi et al. | |
| 7,900,616 | B2 * | 3/2011 | Saunders | 123/688 |
| 2005/0262828 | A1 | 12/2005 | Iihoshi et al. | |
| 2008/0028828 | A1 | 2/2008 | Iihoshi et al. | |
| 2009/0182490 | A1 * | 7/2009 | Saunders | 701/114 |

FOREIGN PATENT DOCUMENTS

| | | | |
|---|---|---|---|
| DE | 38 34 711 | A1 | 4/1990 |
| DE | 4333412 | A1 | 4/1995 |
| DE | 694 05 615 | T2 | 1/1998 |
| DE | 69407685 | T2 | 4/1998 |
| DE | 103 31 334 | A1 | 2/2005 |
| DE | 10 2010 022 683 | A1 | 4/2011 |

(Continued)

OTHER PUBLICATIONS

U.S. Appl. No. 13/672,231, filed Nov. 8, 2012, Levijoki et al.

(Continued)

*Primary Examiner* — Hezron E Williams
*Assistant Examiner* — Nathaniel Kolb

(57) ABSTRACT

A system according to the principles of the present disclosure includes an error period module and a sensor diagnostic module. The error period module determines an error period based on an amount of time that a first air/fuel ratio and a desired air/fuel ratio are different. A first oxygen sensor generates a first signal indicating the first air/fuel ratio. The sensor diagnostic module diagnoses a fault in the first oxygen sensor when the error period is greater than a predetermined period.

20 Claims, 4 Drawing Sheets

(56) References Cited

FOREIGN PATENT DOCUMENTS

| | | | |
|---|---|---|---|
| DE | 102012219626 | A1 | 5/2013 |
| EP | 0616121 | A1 | 9/1994 |
| EP | 1600619 | A2 | 11/2005 |

OTHER PUBLICATIONS

U.S. Appl. No. 13/673,325, filed Nov. 9, 2012, Levijoki et al.
U.S. Appl. No. 14/074,790, filed Nov. 8, 2013, Levijoki et al.
Office Action dated Sep. 10, 2014, from the German Patent Office for German Patent Application No. 10 2013 214 541.1; 7 pages.

* cited by examiner

SYSTEM AND METHOD FOR DIAGNOSING FAULTS IN AN OXYGEN SENSOR

FIELD

The present disclosure relates to systems and methods for diagnosing faults in an oxygen sensor disposed in an exhaust system of an engine.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

An oxygen sensor may be positioned in an exhaust system of an engine. The oxygen sensor may generate an oxygen signal indicating oxygen levels in exhaust gas from the engine. The oxygen signal may also indicate an air/fuel ratio of the engine, which may be referred to as an actual air/fuel ratio. The amount of air and fuel provided to cylinders of the engine may be controlled based on a desired air/fuel ratio, such as a stoichiometric air/fuel ratio, and/or the actual air/fuel ratio.

Fuel control systems may operate in a closed-loop state or an open-loop state. In the closed-loop state, fuel delivery may be controlled to minimize differences between the desired air/fuel ratio and the actual air/fuel ratio. In the open-loop state, fuel delivery may be controlled independent from the actual air/fuel ratio. For example, fuel delivery may be controlled based on a fuel map.

SUMMARY

A system according to the principles of the present disclosure includes an error period module and a sensor diagnostic module. The error period module determines an error period based on an amount of time that a first air/fuel ratio and a desired air/fuel ratio are different. A first oxygen sensor generates a first signal indicating the first air/fuel ratio. The sensor diagnostic module diagnoses a fault in the first oxygen sensor when the error period is greater than a predetermined period.

Further areas of applicability of the present disclosure will become apparent from the detailed description provided hereinafter. It should be understood that the detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

DETAILED DESCRIPTION

An oxygen sensor may be a narrowband sensor or a wideband sensor. A narrowband sensor outputs a voltage indicating whether an air/fuel ratio is rich or lean. For example, an output voltage greater than 450 millivolts (mV) may indicate a rich air/fuel ratio, and an output voltage less than 450 mV may indicate a lean air/fuel ratio. A wideband sensor outputs a voltage indicating the value of the air/fuel ratio.

A bias circuit may cause the oxygen sensor to output a voltage indicating that the air/fuel ratio is rich or lean in the event of an open circuit or a short circuit. For example, an oxygen sensor may normally output a voltage between 50 mV and 850 mV, and the oxygen sensor may output a voltage of 1900 mV when biased. Thus, the oxygen sensor may be stuck in a rich or lean state due to the bias circuit. A sensor that is stuck in a rich or lean state may cause rough engine operation and/or engine stalls.

A system and method according to the principles of the present disclosure diagnoses a fault in an oxygen sensor based on an error period. The error period is the amount of time that a desired air/fuel ratio and an actual air/fuel ratio are different. The actual air/fuel ratio is indicated by a signal generated by the oxygen sensor. The error period may be increased when the desired air/fuel ratio is lean and the actual air/fuel ratio is rich. The error period may also be increased when the desired air/fuel ratio is rich and the actual air/fuel ratio is lean. A fault in the oxygen sensor may be diagnosed when the error period is greater than a predetermined period.

A system and method according to the principles of the present disclosure may operate in an open-loop state or a pseudo-open-loop state when a faulty oxygen sensor is diagnosed. In the open-loop state, fuel delivery may be controlled based on engine operating conditions that are not determined based on input received from an oxygen sensor. In the pseudo-open-loop state, fuel delivery may be controlled based on input received from an oxygen sensor that is not faulty. The open-loop state may be employed when a single oxygen sensor is disposed downstream from an engine (e.g., a single bank engine). The pseudo-open-loop state may be employed when two or more oxygen sensors are disposed downstream from an engine (e.g., a dual bank engine).

Diagnosing a fault in an oxygen sensor based on the error period provides diagnostic information that may be retrieved and utilized when a vehicle is serviced. Controlling fuel delivery in the open-loop state or the pseudo-open-loop state when a faulty oxygen sensor is diagnosed prevents rough engine operation and engine stalls. Preventing rough engine operation and engine stalls improves customer satisfaction.

Figure 1:
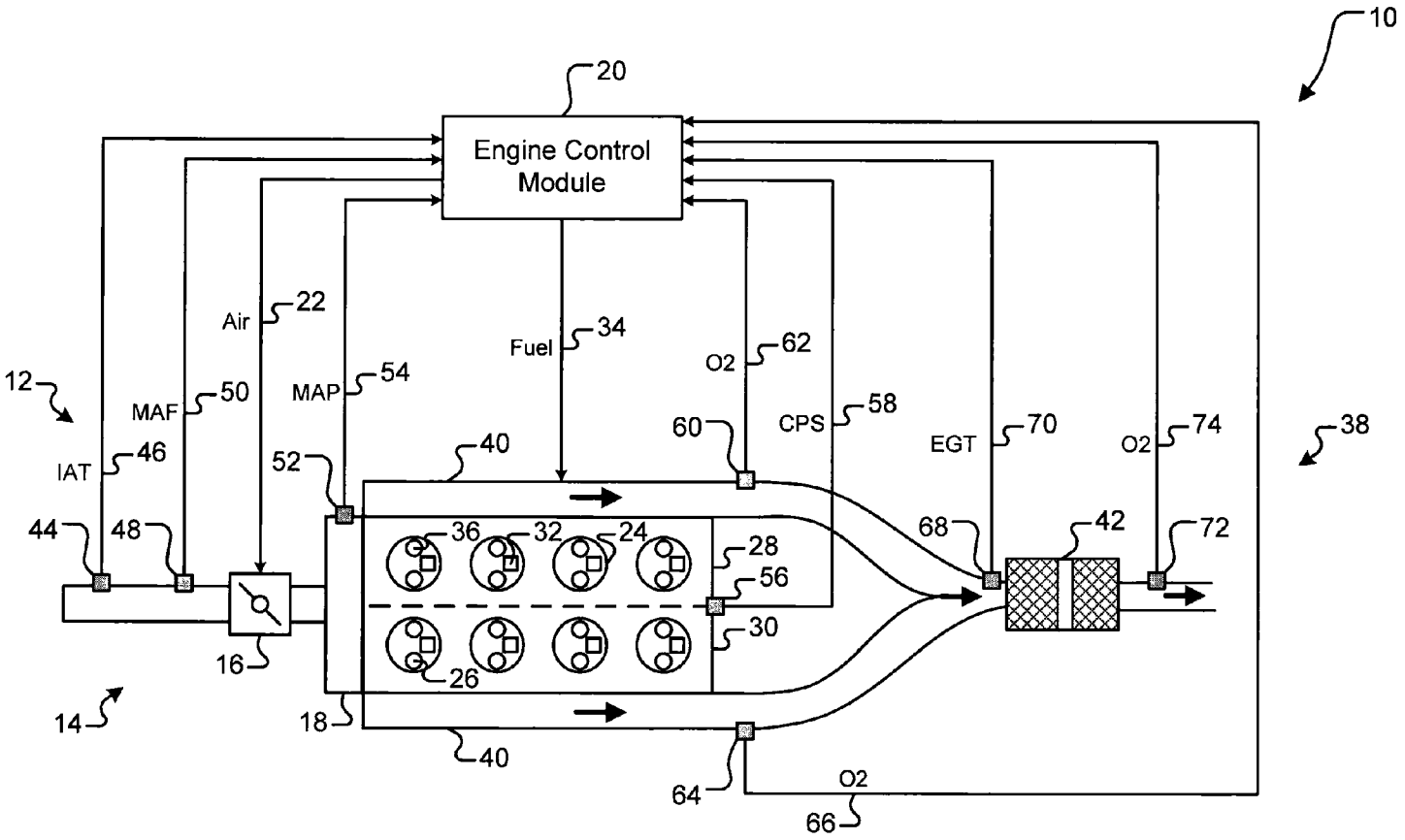
FIG. 1 is a functional block diagram of an example engine system according to the principles of the present disclosure.

Referring to FIG. 1, an engine system 10 includes an engine 12 that combusts an air/fuel mixture to produce drive torque for a vehicle. Air is drawn into the engine 12 through an intake system 14. The intake system 14 includes a throttle valve 16 and an intake manifold 18. The throttle valve 16 may include a butterfly valve having a rotatable blade. The throttle valve 16 opens to draw air into the intake manifold 18. An engine control module (ECM) 20 outputs a throttle control signal 22 to control the amount of air drawn into the intake manifold 18.

Air from the intake manifold 18 is drawn into cylinders 24 of the engine 12 through an intake valve 26. Although the engine 12 is depicting as having eight cylinders, the engine 12 may have more or less cylinders. The engine 12 may be a dual bank engine, and the cylinders 24 may be distributed between a first bank 28 and a second bank 30. Alternatively, the engine 12 may be a single bank engine.

One or more fuel injectors 32 inject fuel into the engine 12. Fuel may be injected into the intake manifold 18 at a central location or at multiple locations, such as near the intake valve 26 of each of the cylinders 24. In various implementations, fuel may be injected directly into the cylinders 24 or into mixing chambers associated with the cylinders 24. The ECM 20 outputs a fuel control signal 34 to control the amount of fuel injected by the fuel injectors 32.

The injected fuel mixes with air and creates an air/fuel mixture in the cylinders 24. Pistons (not shown) within the cylinders 24 compress the air/fuel mixture. The engine 12 may be a compression-ignition engine, in which case compression in the cylinders 24 ignites the air/fuel mixture. Alternatively, the engine 12 may be a spark-ignition engine, in which case spark plugs (not shown) in the cylinder 24 generate a spark that ignites the air/fuel mixture. The ECM 20 may output a spark control signal (not shown) to control when the spark plugs generate a spark (i.e., spark timing).

The byproducts of combustion are expelled through an exhaust valve 36 and exhausted from the vehicle through an exhaust system 38. The exhaust system 38 includes an exhaust manifold 40 and a three-way catalyst (TWC) 42. The TWC 42 reduces nitrogen oxide and oxidizes carbon monoxide and hydrocarbon. The TWC 42 may store oxygen when an air/fuel ratio of the engine 12 is lean, and oxygen stored in the TWC 42 may be consumed as carbon monoxide and hydrocarbon are oxidized when the air/fuel ratio is rich. The ECM 20 may oscillate the air/fuel ratio between rich and lean within a narrow band near a stoichiometric air/fuel ratio to minimize emissions.

An intake air temperature (IAT) sensor 44 measures the temperature of air drawn through the intake system 14 and generates an IAT signal 46 indicating the intake air temperature. A mass airflow (MAF) sensor 48 measures the mass flow rate of air drawn through the intake system and generates a MAF signal 50 indicating the mass airflow. A manifold absolute pressure (MAP) sensor 52 measures pressure in the intake manifold 18 and generates a MAP signal 54 indicating the manifold pressure. A crankshaft position (CPS) sensor 56 measures the position of the crankshaft and generates a CPS signal 58 indicating the position of the crankshaft (and engine speed).

A first oxygen (O2) sensor 60 measures a first oxygen level in exhaust gas from the first bank 28 and generates a first O2 signal 62 indicating the first oxygen level. A second O2 sensor 64 measures a second oxygen level in exhaust gas from the second bank 30 and generates a second O2 signal 66 indicating the second oxygen level. An exhaust gas temperature (EGT) sensor 68 measures the temperature of exhaust gas and generates an EGT signal 70 indicating the exhaust gas temperature. A third O2 sensor 72 measures a third oxygen level in exhaust gas downstream from the TWC 42 and generates a third O2 signal 74 indicating the third oxygen level. The oxygen sensors 60, 64, 72 may be narrowband sensors or wideband sensors.

The ECM 20 receives the signals generated by the sensors discussed above and controls the engine 12 based on the signals received. The ECM 20 may diagnose a fault in the first O2 sensor 60 and/or the second O2 sensor 64. Although the ECM 20 may diagnose a fault in either of the oxygen sensors 60, 64, for simplicity, the discussion below describes the ECM 20 diagnosing a fault in the first O2 sensor 60. The ECM 20 may diagnose a fault in the second O2 sensor 64 in a similar manner.

The ECM 20 diagnoses a fault in the first O2 sensor 60 based on an error period. The error period is the amount of time that a desired air/fuel ratio and an actual air/fuel ratio are different. The ECM 20 adjusts the fuel control signal 34 to achieve the desired air/fuel ratio. The ECM 20 determines the actual air/fuel ratio based on the first O2 signal 62.

The ECM 20 may increase the error period when the desired air/fuel ratio is lean and the actual air/fuel ratio is rich. The ECM 20 may increase the error period when the desired air/fuel ratio is rich and the actual air/fuel ratio is lean. The ECM 20 may diagnose a fault in the first O2 sensor 60 when the error period is greater than a predetermined period.

Figure 2:
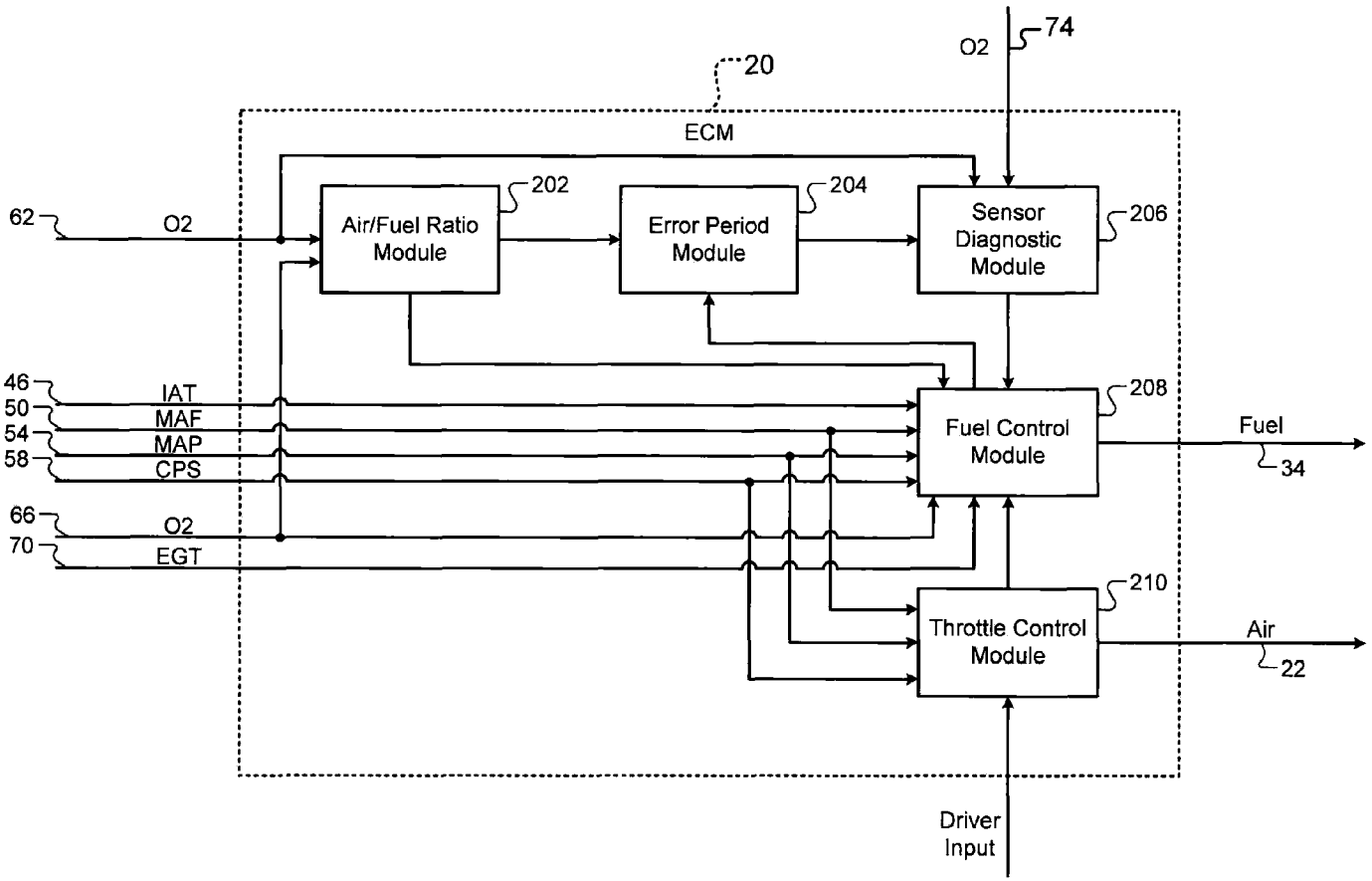
FIG. 2 is a functional block diagram of an example control system according to the principles of the present disclosure.

Referring to FIG. 2, an example implementation of the ECM 20 includes an air/fuel ratio module 202, an error period module 204, a sensor diagnostic module 206, a fuel control module 208, and a throttle control module 210. The air/fuel ratio module 202 determines whether an actual air/fuel ratio is rich or lean based on the first O2 signal 62. For example, the actual air/fuel ratio may be rich when the first O2 signal 62 is greater than a predetermined voltage (e.g., 450 mV) and the actual air/fuel ratio may be lean when the first O2 signal 62 is less than the predetermined voltage. The predetermined voltage may correspond to a stoichiometric air/fuel ratio. The air/fuel ratio module 202 outputs a signal indicating whether the actual air/fuel ratio is rich or lean.

The air/fuel ratio module 202 may determine the value of the actual air/fuel ratio based on the first O2 signal 62 and/or the type of fuel combusted by the engine 12. For example, the air/fuel ratio module 202 may determine that the actual air/fuel ratio is 14.7 when the first O2 signal 62 is equal to the predetermined voltage and the fuel type is gasoline. The fuel type may be predetermined and/or provided to the air/fuel ratio module 202 using, for example, an instrument panel and/or a service tool. The air/fuel ratio module 202 may output the value of the actual air/fuel ratio.

The error period module 204 determines an error period based on the actual air/fuel ratio and a desired air/fuel ratio. The error period is the amount of time that the actual air/fuel ratio and the desired air/fuel ratio are different. The desired air/fuel ratio may be a predetermined ratio such as a stoichiometric ratio. Alternatively, the fuel control module 208 may determine the desired air/fuel ratio, as discussed below, and output the desired air/fuel ratio to the error period module 204.

The error period module 204 may increase a rich error period when the desired air/fuel ratio is lean and the actual air/fuel ratio is rich. The error period module 204 may increase a lean error period when the desired air/fuel ratio is rich and the actual air/fuel ratio is lean. The error period module 204 may set the error period to zero when the desired air/fuel ratio and the actual air/fuel ratio are either rich or lean. The error period module 204 outputs the error periods.

The sensor diagnostic module 206 diagnoses a fault in the first O2 sensor 60 based on an error period. The sensor diagnostic module 206 may diagnose a stuck rich fault when the rich error period is greater than a predetermined period (e.g., 3 seconds). The sensor diagnostic module 206 may diagnose a stuck lean fault when the lean error period is greater than the predetermined period. The sensor diagnostic module 206 outputs a signal indicating when a fault in the first O2 sensor 60 is diagnosed. The sensor diagnostic module 206 may also set a diagnostic trouble code and/or activate a service indicator such as a visible message when a fault in the first O2 sensor 60 is diagnosed.

The sensor diagnostic module 206 may refrain from diagnosing a fault in the first O2 sensor 60 when the first O2 signal 62 and the third O2 signal 74 indicate a lean air/fuel ratio or when the first O2 signal 62 and the third O2 signal 74 indicate a rich air/fuel ratio. The sensor diagnostic module 206 may diagnose the stuck lean fault when the lean error period is greater than the predetermined period and the third O2 signal 74 indicates a rich air/fuel ratio. The sensor diagnostic module 206 may diagnose the stuck rich fault when the rich error period is greater than the predetermined period and the third O2 signal 74 indicates a lean air/fuel ratio.

The fuel control module 208 outputs the fuel control signal 34 to control the amount of fuel (i.e., the fuel mass) injected by the fuel injectors 32. The fuel control module 208 may control the fuel mass based on the amount of air (i.e., the air mass) drawn into the intake manifold 18 to achieve the desired air/fuel ratio. The throttle control module 210 may determine the air mass, as discussed below, and output the air mass to the fuel control module 208. The fuel control module 208 may determine the desired air/fuel ratio based on engine operating conditions to minimize emissions. The engine operating conditions may include the intake air temperature, the mass airflow, the manifold pressure, the engine speed, and/or the exhaust gas temperature.

The fuel control module 208 may operate in a closed-loop state when the first O2 sensor 60 is operating normally. In the closed-loop state, the fuel control module 208 adjusts the fuel mass to minimize differences between the desired air/fuel ratio and the actual air/fuel ratio. The fuel control module 208 may control fuel delivery to the first bank 28 based on input received from the first O2 sensor 60 and control fuel delivery to the second bank 30 based on input received from the second O2 sensor 64. Alternatively, the first O2 sensor 60 may be downstream from the first bank 28 and the second bank 30, and the fuel control module 208 may control fuel delivery to the first bank 28 and the second bank 30 based on input received from first O2 sensor 60.

The fuel control module 208 may operate in an open-loop state or a pseudo-open-loop state when a fault is diagnosed in the first O2 sensor 60. The fuel control module 208 may operate in the pseudo-open-loop state when more than one O2 sensor is disposed downstream from the engine 12 and one of the O2 sensors is not faulty. The fuel control module 208 may operate in the open-loop state when only a faulty O2 sensor is disposed downstream from the engine 12.

In the open-loop state, the fuel control module 208 may control fuel delivery independent from input received from the first O2 sensor 60. For example, the fuel control module 208 may control fuel delivery based on a fuel map. The fuel map may specify fuel delivery parameters (e.g., fuel mass, fueling rate) based on engine operating conditions. The engine operating conditions may include the intake air temperature, the mass airflow, the manifold pressure, the engine speed, and/or the exhaust gas temperature.

In the pseudo-open-loop state, when a fault is diagnosed in the first O2 sensor 60, the fuel control module 208 may control fuel delivery to the first bank 28 and the second bank 30 based on input received from the second O2 sensor 64. For example, the fuel control module 208 may control fuel delivery to the first bank 28 and the second bank 30 to minimize differences between an actual air/fuel ratio and the desired air/fuel ratio. The air/fuel ratio module 202 may determine the actual air/fuel ratio based on the second O2 signal 66. Conversely, when a fault is diagnosed in the second O2 sensor 64, the fuel control module 208 may control fuel delivery to the first bank 28 and the second bank 30 based on input received from the first O2 sensor 60.

The throttle control module 210 outputs the throttle control signal 22 to control the amount of air (i.e., the air mass) drawn into the intake manifold 18. The throttle control module 210 may adjust the air mass to minimize differences between a desired air mass and an actual air mass. The throttle control module 210 may determine the desired air mass based on driver input. For example, the driver input may be generated based on an accelerator pedal position and/or a cruise control setting.

The throttle control module 210 may determine the actual air mass based on engine operating conditions. The engine operating conditions may include the intake air temperature, the mass airflow, and/or the manifold pressure. The engine operating conditions may also include a throttle position. The throttle position may be measured and/or determined based on the throttle control signal 22. The throttle control module 210 may adjust the throttle position to minimize differences between a desired throttle position and an actual throttle position. The throttle control module 210 may determine the desired throttle position based on the driver input and output the resulting air mass.

Figure 3:
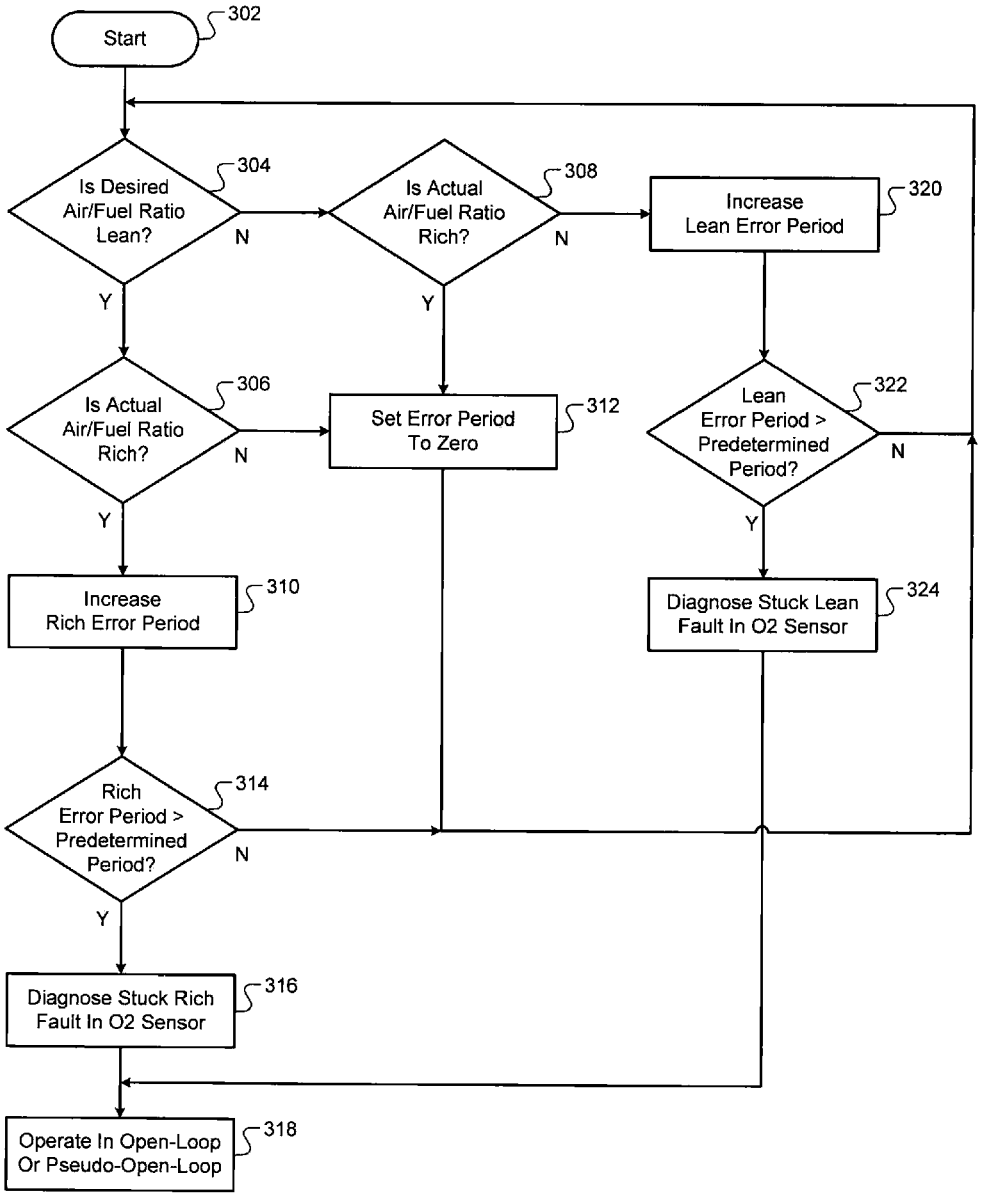
FIG. 3 is a flowchart illustrating an example control method according to the principles of the present disclosure.

Referring to FIG. 3, a method for diagnosing a fault in an oxygen sensor begins at 302. The oxygen sensor may be a narrowband sensor or a wideband sensor. At 304, the method determines whether a desired air/fuel ratio is lean. If 304 is true, the method continues at 306. Otherwise, the method continues at 308.

The desired air/fuel ratio may be a predetermined ratio such a stoichiometric ratio or a ratio that oscillates between rich and lean within a predetermined range. The method may determine the desired air/fuel ratio based on engine operating conditions. The engine operating conditions may include intake air temperature, mass airflow, manifold pressure, engine speed, and/or exhaust gas temperature.

At 306, the method determines whether an actual air/fuel ratio is rich. If 306 is true, the method continues at 310. Otherwise, the method continues at 312. The method determines whether the actual air/fuel ratio is rich or lean based on output voltage of the oxygen sensor. For example, the actual air/fuel ratio may be rich when the output voltage is greater than 450 millivolts (mV), and the actual air/fuel ratio may be lean when the output voltage is less than 450 millivolts.

At 310, the method increases a rich error period. At 314, the method determines whether the rich error period is greater than a predetermined period (e.g., 3 seconds). If 314 is true, the method continues at 316. Otherwise, the method continues at 304. At 316, the method diagnoses a stuck rich fault in the oxygen sensor. The method may set a diagnostic trouble code and/or activate a service indicator such as a visible message to indicate when the stuck rich fault is diagnosed.

At 318, the method operates in an open-loop state or a pseudo-open-loop state. In the open-loop state, the method controls fuel delivery independent from input received from an oxygen sensor. In the pseudo-open-loop state, the method controls fuel delivery based on input received from an oxygen sensor that is not faulty.

At 308, the method determines whether the actual air/fuel ratio is rich. If 308 is true, the method continues at 312. Otherwise, the method continues at 320. At 320, the method increases a lean error period. At 312, the method sets an error period to zero. The method may set the rich error period to zero and/or set the lean error period to zero.

At 322, the method determines whether the lean error period is greater than the predetermined period. If 322 is true, the method continues at 324. Otherwise, the method continues at 304. At 324, the method diagnoses a stuck lean fault in the oxygen sensor. The method may set a diagnostic trouble code and/or activate a service indicator such as a visible message to indicate when the stuck lean fault is diagnosed.

Figure 4:
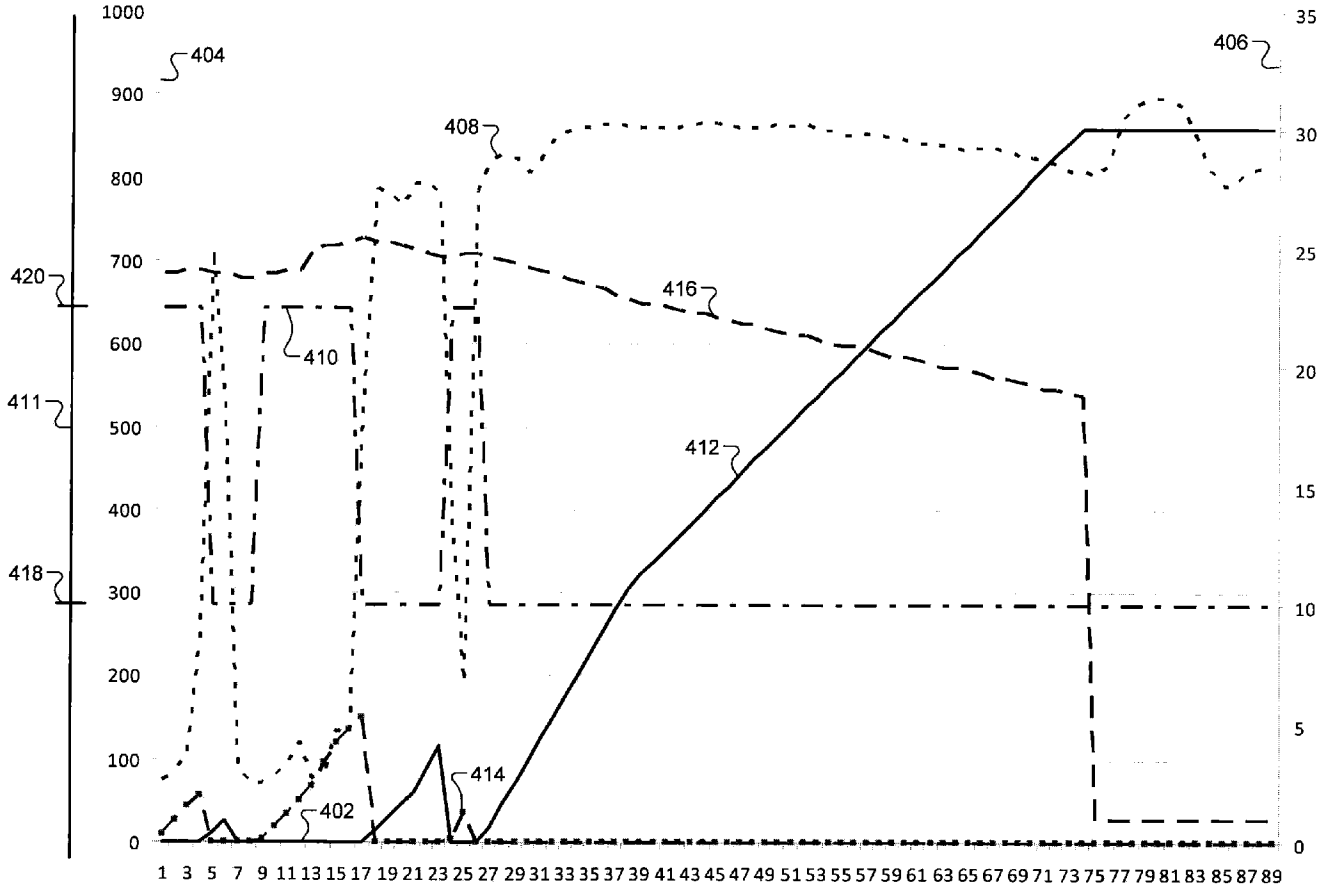
FIG. 4 is a graph illustrating example control signals according to the principles of the present disclosure.

Referring now to FIG. 4, an x-axis 402 represents a first sample count, a y-axis 404 represents voltage in millivolts (mV), and a y-axis 406 represents a second sample count. The first sample count and the second sample count indicate periods. The periods may be determined based on the sampling rates of the first sample count and the second sample count. The sampling rate of the first sample count is 250 milliseconds (ms), and the sampling rate of the second sample count is 100 ms.

An actual voltage 408 output by an oxygen sensor is plotted relative to the x-axis 402 and the y-axis 404. A desired state 410 of the oxygen sensor is plotted relative to the x-axis 402 and a y-axis 411. A rich error period 412, a lean error period 414, and an error correction voltage 416 are plotted relative to the x-axis 402 and the y-axis 406. The desired state 410 may be a lean state 418 or a rich state 420. Fuel delivery to an engine may be controlled based on the desired state 410 and the error correction 416.

The rich error period 412 increases and the lean error period 414 decreases when the actual voltage 408 is greater than a predetermined voltage and the desired state 410 is the lean state 418. The predetermined voltage may be a voltage that corresponds to a stoichiometric air/fuel ratio. The rich error period 412 decreases and the lean error period 414 increases when the actual voltage 408 is less than the predetermined voltage and the desired state 410 is the rich state 420. A stuck rich fault in the oxygen sensor is diagnosed when the rich error period 412 equals 3 seconds (i.e., product of 30 counts and 100 ms). Fuel delivery to the engine may be controlled independent from the actual voltage 408 when the stuck rich fault is diagnosed. For example, fuel delivery to the engine may be controlled based on input received from a different oxygen sensor that is not faulty.

The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. For purposes of clarity, the same reference numbers will be used in the drawings to identify similar elements. As used herein, the phrase at least one of A, B, and C should be construed to mean a logical (A or B or C), using a non-exclusive logical OR. It should be understood that one or more steps within a method may be executed in different order (or concurrently) without altering the principles of the present disclosure.

As used herein, the term module may refer to, be part of, or include an Application Specific Integrated Circuit (ASIC); an electronic circuit; a combinational logic circuit; a field programmable gate array (FPGA); a processor (shared, dedicated, or group) that executes code; other suitable hardware components that provide the described functionality; or a combination of some or all of the above, such as in a system-on-chip. The term module may include memory (shared, dedicated, or group) that stores code executed by the processor.

The term code, as used above, may include software, firmware, and/or microcode, and may refer to programs, routines, functions, classes, and/or objects. The term shared, as used above, means that some or all code from multiple modules may be executed using a single (shared) processor. In addition, some or all code from multiple modules may be stored by a single (shared) memory. The term group, as used above, means that some or all code from a single module may be executed using a group of processors. In addition, some or all code from a single module may be stored using a group of memories.

The apparatuses and methods described herein may be implemented by one or more computer programs executed by one or more processors. The computer programs include processor-executable instructions that are stored on a non-transitory tangible computer readable medium. The computer programs may also include stored data. Non-limiting examples of the non-transitory tangible computer readable medium are nonvolatile memory, magnetic storage, and optical storage.

What is claimed is:

1. A system comprising:

an error period module that determines an error period based on an amount of time that a first air/fuel ratio and a desired air/fuel ratio are different and independent of whether the desired air/fuel ratio is changed, wherein a first oxygen sensor generates a first signal indicating the first air/fuel ratio; and a sensor diagnostic module that diagnoses a fault in the first oxygen sensor when the error period is greater than a predetermined period.

2. The system of claim 1, wherein the error period module increases the error period when the first air/fuel ratio is rich and the desired air/fuel ratio is lean.

3. The system of claim 1, wherein the error period module increases the error period when the first air/fuel ratio is lean and the desired air/fuel ratio is rich.

4. The system of claim 1, wherein the error period module sets the error period to zero when the first air/fuel ratio and the desired air/fuel ratio are both one of rich and lean.

5. The system of claim 1, wherein the first oxygen sensor is a narrowband sensor.

6. The system of claim 1, wherein the first oxygen sensor is a wideband sensor.

7. The system of claim 1, further comprising a fuel control module that controls fuel delivery to an engine independent from the first air/fuel ratio when the fault is diagnosed.

8. The system of claim 7, wherein the fuel control module controls fuel delivery to the engine based on an engine operating condition that is not determined based on input received from an oxygen sensor.

9. The system of claim 7, wherein the fuel control module controls fuel delivery to the engine based on a second air/fuel ratio when the fault is diagnosed, wherein a second oxygen sensor generates a second signal indicating the second air/fuel ratio.

10. The system of claim 9, wherein the first oxygen sensor is disposed downstream from a first set of cylinders, the second oxygen sensor is disposed downstream from a second set of cylinders, and the fuel control module controls fuel delivery to the first set and the second set based on the second air/fuel ratio when the fault is diagnosed.

11. A method comprising:

determining an error period based on an amount of time that a first air/fuel ratio and a desired air/fuel ratio are different and independent of whether the desired air/fuel ratio is changed, wherein a first oxygen sensor generates a first signal indicating the first air/fuel ratio; and diagnosing a fault in the first oxygen sensor when the error period is greater than a predetermined period.

12. The method of claim 11, further comprising increasing the error period when the first air/fuel ratio is rich and the desired air/fuel ratio is lean.

13. The method of claim 11, further comprising increasing the error period when the first air/fuel ratio is lean and the desired air/fuel ratio is rich.

14. The method of claim 11, further comprising setting the error period to zero when the first air/fuel ratio and the desired air/fuel ratio are both one of rich and lean.

15. The method of claim 11, wherein the first oxygen sensor is a narrowband sensor.

16. The method of claim 11, wherein the first oxygen sensor is a wideband sensor.

17. The method of claim 11, further comprising controlling fuel delivery to an engine independent from the first air/fuel ratio when the fault is diagnosed.

18. The method of claim 17, further comprising controlling fuel delivery to the engine based on an engine operating condition that is not determined based on input received from an oxygen sensor.

19. The method of claim 17, further comprising controlling fuel delivery to the engine based on a second air/fuel ratio when the fault is diagnosed, wherein a second oxygen sensor generates a second signal indicating the second air/fuel ratio.

20. The method of claim 19, further comprising controlling fuel delivery to a first set of cylinders and a second set of cylinders based on the second air/fuel ratio when the fault is diagnosed, wherein the first oxygen sensor is disposed downstream from the first set and the second oxygen sensor is disposed downstream from the second set.

* * * * *